United States Patent [19]

Pollmann

[11] Patent Number: 4,821,300

[45] Date of Patent: Apr. 11, 1989

[54] ROLLER COUNTER

[76] Inventor: Herbert Pollmann, Thumastrasse 9, A-3822 Karlstein/Thaya, Austria

[21] Appl. No.: 62,461

[22] PCT Filed: Sep. 17, 1986

[86] PCT No.: PCT/AT86/00058

§ 371 Date: May 20, 1987

§ 102(e) Date: May 20, 1987

[87] PCT Pub. No.: WO87/01843

PCT Pub. Date: Mar. 26, 1987

[30] Foreign Application Priority Data

Sep. 20, 1985 [AT] Austria ..... 2758/85

[51] Int. Cl.[4] ..... G06M 1/36

[52] U.S. Cl. ..... 377/88; 377/92; 235/103; 235/144 PN; 235/144 SP

[58] Field of Search ..... 235/144 SP, 144 PN, 235/95 R, 95 B, 105, 103; 377/82, 88, 92

[56] References Cited

U.S. PATENT DOCUMENTS 2,673,685 3/1954 Hoffmann ..... 377/92

2,966,301 12/1960 Fowlie ..... 235/144 PN

FOREIGN PATENT DOCUMENTS 2201792 4/1974 France .

1570671 7/1980 United Kingdom .

*Primary Examiner*—John S. Heyman

*Attorney, Agent, or Firm*—Remy J. VanOphem

[57] ABSTRACT

A roller counter, which can be reset to zero position via its axis has, for the purpose of stepping its digit rollers, a lock pawl swivellably supported on a side wall of the digit rollers for being swivelled around a pin. A pestle, serving the purpose of zero setting, is supported for swivelling movement around a second pin on the digit roller and cooperates with a stop on the axis. The locking pawl and the pestle each are spring-loaded to a predetermined degree by a leg of a leaf spring bent to V-shape. The leaf spring is held on the digit roller by means of a mounting including walls accompanying both legs of the leaf spring at the inner side and at the outer side and contacting the legs according to a surface-to-surface contact.

17 Claims, 2 Drawing Sheets

ROLLER COUNTER

BACKGROUND OF THE INVENTION

1. Field of the Invention

This invention relates to roller counters including at least two digit rollers arranged on a common axis.

2. Description of the Prior Art

Roller counters are in particular used as kilometer counters or mileage counters for vehicles but are also used as counters in sound recorders, video recorders and so on. In a known construction of such a roller counter, the leaf spring provided for each roller is maintained on the digit roller by means of protrusions designed like pins, some of the pins facing the inner side of the spring and some of the pins facing the outer side of the spring. It has been found that this provides for a secure positioning of the leaf spring but not for a definite predetermined position of the spring in all counters. As a consequence, the initial stress by which the legs of the leaf spring make contact with the pestle and, respectively, the lock pawl, is subject to wide variations from digit roll to digit roll. The result is that the stepping procedure and, respectively, the zero stepping procedure is inexact, resulting in reading errors.

SUMMARY OF THE INVENTION

It is an object of the invention to improve the mounting of the leaf spring on the digit roller of a roller counter such that the leaf spring contacts the lock pawl and the pestle with a predetermined initial force so that both these component parts are loaded with a predetermined pre-load and, thus, experience the same pre-load conditions for all digit rollers of the roller counter as well as for roller counters of the same construction.

This object of the invention is achieved by forming the protrusions into walls contacting the leaf spring and accompanying both legs of the leaf spring at its outer side as well as its inner side. A further wall is also provided at the outer surface of the bent area of the leaf spring and accompanies the bend of the leaf spring. In the construction according to the invention, there is, thus, always a surface in contact between the wall protrusions and the leaf spring, whereas contact is always only a line contact in the initially described known prior art construction. During assembly, the leaf spring is brought into a definite predetermined position, so that the leaf spring contacts with its legs the pestle and, respectively, the lock pawl with a definite predetermined pre-load even if the leaf spring has a varying angular aperture of both legs due to production tolerances. The walls accompanying the inner surface and the outer surface, respectively, of the leaf spring provide for a definite mounted position of the leaf spring so that any mis-assembling is prevented.

According to a preferred embodiment of the invention, both legs of the leaf spring are, up to the beginning of the bent area, accompanied by two equal wall pairs and the outer walls of these wall pairs are joined together in a manner arcuately extending around the bent area. In this manner, there results a pocket-like seat for the leaf spring which facilitates assembly of the leaf spring, on the one hand, and maintains the leaf spring in position in an optimum manner, on the other hand. A symmetrical design of both wall pairs is particularly suitable for leaf springs of symmetric design, i.e., leaf springs having legs of equal length, because in this case each leg of the leaf spring can be put into each slot formed of both wall pairs, so that the leaf spring can be inserted into its mounting at the digit roller in each of both possible positions.

According to a further embodiment of the invention, the arrangement is such that, within the area of the apex of the bent area, the wall facing the inner side of the leaf spring is relieved relative to the leaf spring, so that within this area the leaf spring is not contacted at its inner side by a wall. It has in some cases been found that the leaf spring tends to experience an uprising movement if the wall pairs continuously follow the curvature of the leaf spring.

According to the invention, the walls maintaining the leaf spring in position may carry protrusions extending beyond the cross section of the leaf spring for being pinched in order to extend over the cross section of the leaf spring. In this manner, the leaf spring is prevented from leaving its mounting. Suitable pinchable materials are in particular synthetic plastic materials which form, as a rule, the digit rollers and are known in the prior art.

The present invention has non-rotatably supported bearing plates arranged between the digit rollers for bearingly supporting stepping pinions coordinated to the digit rollers. Each of the stepping pinions is driven by a teeth pair of the digit roller and is in meshing engagement with a cog of a ring bearingly supported on a collar of the second or, respectively, each following digit roller. The roller counter has a plurality of inwardly facing recesses, one of which is engaged by a spring-loaded lock pawl supported on the digit roller which serves the purpose of fixing the position of the ring relative to the digit roller for the purpose of zero setting all digit rollers. The axis of the roller counter is rotatable and each digit roller has a stop which strikes, during zero setting of the axis, a spring-loaded pestle swivellably supported on the digit roller. The spring-loaded pestle and the lock pawl are loaded by one leg each of a leaf spring bent into a V-shape or, alternatively, a U-shape, where the leaf spring is held within the area of its bend by lateral protrusions of the digit roller.

The arrangement according to the invention can further be such that each of the lock pawl and the pestle are supported with a bearing bore on one pin each of the digit roller. These pins carry cams extending in normal relation to the pin axis and engage recesses in the bearing bore. These recesses are larger than the cams for the amount of the swivelling area of the lock pawl and, respectively, the pestle, and the cam associated with the pestle is directed in a direction other than the cam associated with the recess. In this manner, it is simple to prevent, during assembly, the pestle and the lock pawl from being mounted in interchanged position, which occurred in known constructions, on account of the similarity of both component parts and which can result in complications during operation.

BRIEF DESCRIPTION OF THE DRAWINGS

In the drawing, the subject of the invention is schematically illustrated with reference to examples of the preferred embodiment.

DETAILED DESCRIPTION OF THE PREFERRED EMBODIMENT

Figure 1:
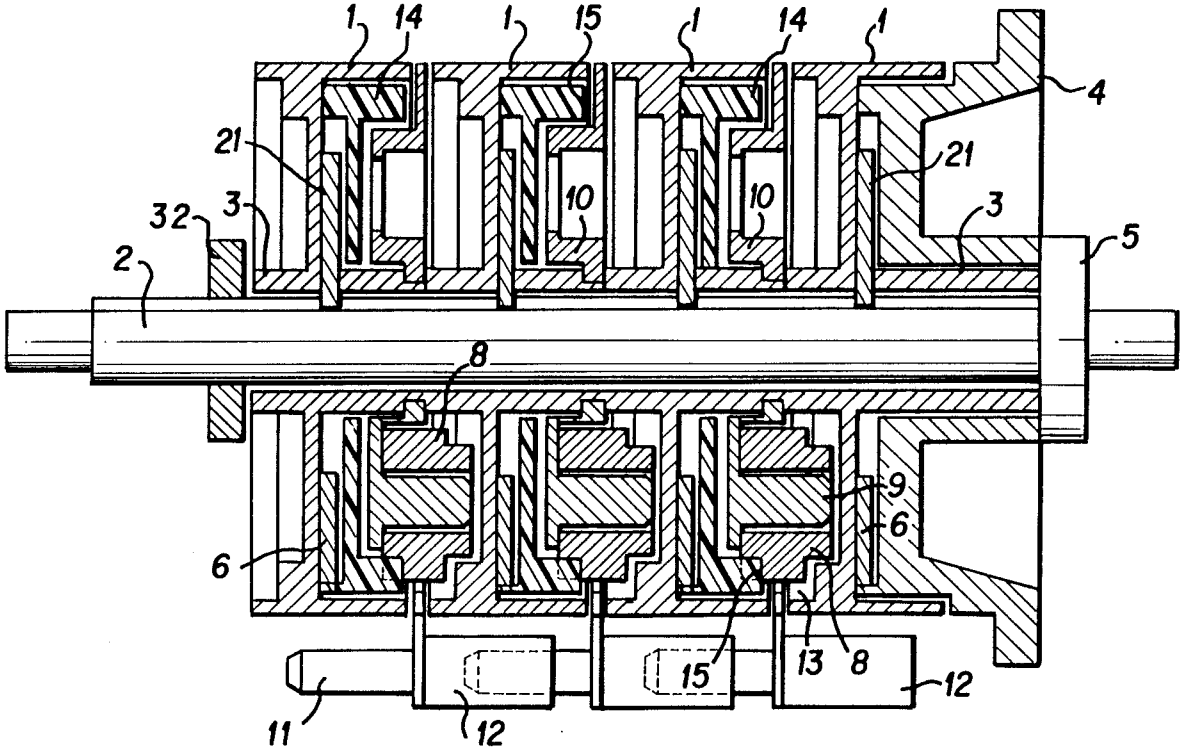
FIG. 1 shows a cross section along the central axis of a basic construction of the roller counter.
Figure 2:
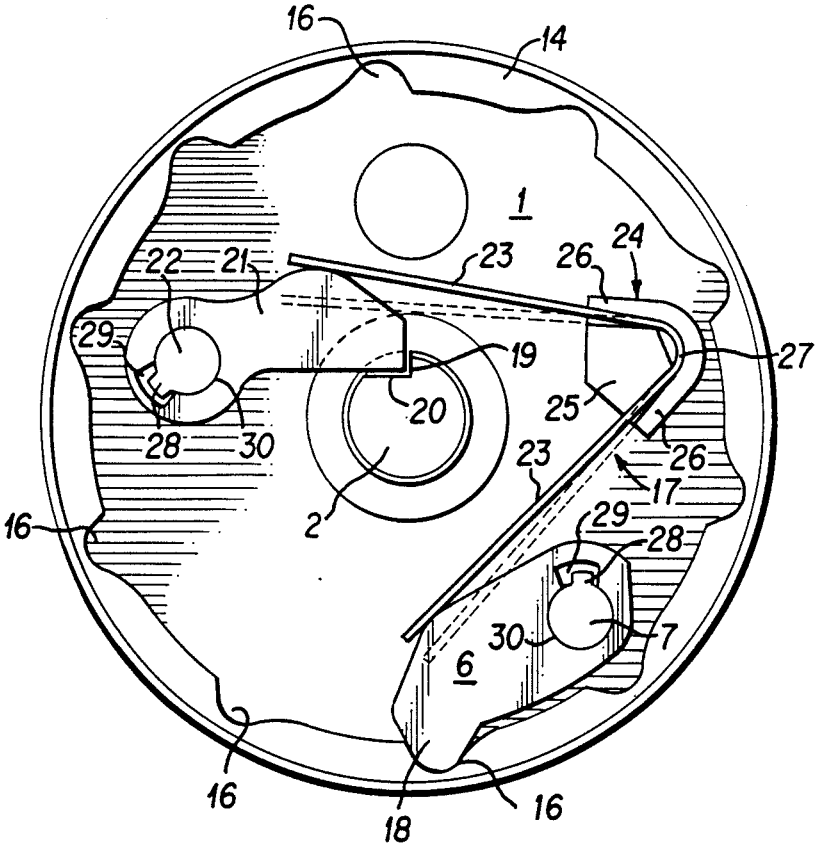
FIG. 2 shows a side view of a digit roller along the axial direction together with the component parts supported thereon.
Figure 3:
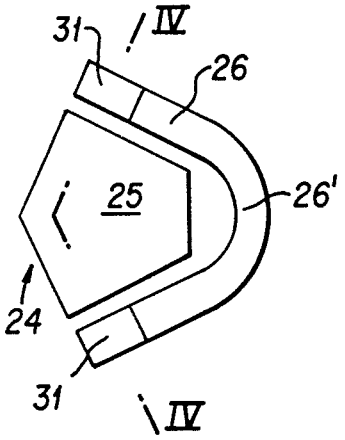
FIG. 3 is a plan view showing in an enlarged scale the walls holding the leaf spring.

The roller counter shown in FIG. 1 has, in its basic construction, four digit rollers 1 corresponding to the individual decimal values of a number to be displayed having four places. The digit rollers are seated on a common central axis 2 by means of central collars 3 which allow for rotation. One collar 3 is elongated in the axial direction in case of the digit roller 1 which registers the lowest numeral place, the elongation forming the bearing support for a tooth gear 4, which drives the roller counter during operation and which is prevented from being drawn off the collar 3 by a flange 5 on the axis 2. The tooth gear 4 drives the first digit roller 1 in one direction that is, for summing up, by means of a lock pawl 6 which is swivellably supported on a pin 7, as shown in FIG. 2, of the digit roller 1. Stepping operation from one digit roller 1 to the next digit roller is effected via a stepping pinion 8 which is rotatably supported on a bolt 9 of a profiled bearing plate 10 arranged between two mutually adjacent digit rollers 1 and supported on the collars of the adjacent digit roller 1. Each of the bearing plates 10 is provided outside of the periphery of the digit rollers 1 with a pin 11 axially protruding in a direction to one side and snugly engaging a corresponding bore of a bushing 12 extending from the bearing plate 10 in an opposite direction relative to the pin 11. The bearing plates 10 are, thus, coupled one with the other and are prevented from rotation, because the pin 11, illustrated in FIG. 1 at the extreme left-hand side, engages a stationary rest, not shown.

Each stepping pinion 8 is driven by a dog formed of two teeth 13 of the immediately adjacent digit roller 1 and drives in its turn a ring 14 located adjacent the stepping pinion 8. The ring 14 has gearing 15 which communicates with the teeth of the stepping pinion 8. The ring 14 is rotatably supported on the collar 3 of the subsequent digit roller 1 and carries at its side located opposite the gearing 15 a series of ten inwardly facing recesses 16 shown in FIG. 2. One of these recesses 16 is engaged by the lock pawl 6 of the adjacent digit roller 1. The lock pawl 6 is pre-loaded by a leaf spring 17, as shown in FIG. 2, so that the ring 14 is held in the correct position and can be rotated in only one direction relative to the digit roller 1. During rotation of the ring 14 in this one direction, the lock pawl 6 slides out of its respective recess 16 and slips over the inner circumference of the circumferential wall, which is provided with the recesses 16, of the ring 14, until the lock pawl 6 falls into the next recess 16 under the pre-load of the leaf spring 17. Rotation of the ring 14 in the other direction is prevented by giving a suitable shape to the recesses 16 which are engaged by a nose 18 of the lock pawl 6.

Zero-setting of the roller counter is effected by rotating the central axis 2, shown in FIG. 2, counterclockwise. The central axis has, for each digit roller, a stop 19 formed by a nose configured by a depression 20 in the axis 2 and has, as seen in the Figure, an angle at 90°. A pestle 21, shown in FIG. 2, also pre-loaded by the leaf spring 17, falls into the depression 20. The pestle is pivotally supported on a pin 22, laterally protruding from the side wall of the digit roller 1. In normal operation, the digit roller 1 rotates counterclockwise, as seen in FIG. 2, so that the pestle 21 slides along the circumference of the axis 2, and is stationary in this condition. If, however, the axis 2 is rotated counterclockwise, the pestle 21 falls into the depression 20, so that the stop 19 of the axis 2 moves the pestle forwardly in its longitudinal direction and, thus, transfers the digit roller 1 into zero position.

The lock pawl 6 and the pestle 21 each are pre-loaded by one respective leg 23 of the leaf spring 17 which contacts the pestle 21 and, respectively, the lock pawl 6 with a predetermined initial load. For this purpose, the leaf spring 17, which is bent to be V-shaped or U-shaped and has legs of equal length, is held within a mounting 24 of the side wall of the digit roller 1. The mounting 24 is formed of walls 25 and 26 arranged inside and outside on the leaf spring 17. The walls are in surface contact with the leaf spring 17, and the walls are arranged within the area of the bent portion 27 of the leaf spring 17 so as to contact both legs 23. The inner wall 25 and the outer wall 26, thus, form a gap located between them for snugly receiving the respective legs 23 of the leaf spring 17. Both outer walls 26 are joined by a further wall 26', so that they continuously follow the leaf spring 17 at the outer side of the bent portion 27 of the leaf spring 17. The pocket formed thereby serves to reliably hold the leaf spring 17 in place. At the inner side of the bent portion 27 of the leaf spring 17, the inner walls 25 adjoin the leaf spring 17 only up to the beginning of the bent portion 27, so that the bent portion 27 is kept free of walls at its inner side. The orientation of the slots delimited by the walls 25 and 26 for receiving both the legs 23 of the leaf spring 17 is selected such that the leaf spring 17 contacts with its legs 23 the lock pawl 6 and the pestle 21 with a predetermined pre-load which presses the lock pawl 6 into the locking position in which the lock pawl 6 engages with its nose 18 one of the recesses 16. This tensioned position of the leaf spring 17 is shown with full lines in FIG. 2, whereas the relaxed position of both legs 23 of the leaf spring 17 is shown in dashed lines.

As shown in FIG. 2, both the pins 7 and 22, by means of which the lock pawl 6 and the pestle 21 are swivellably linked on the digit roller 1, are provided with a cam 28 protruding in normal relation to the pin axis. This cam 28 slides, during the swivelling movement of the lock pawl and the pestle 21, within a recess 29 of a bearing bore 30, with which the lock pawl 6 and, respectively, the pestle 21 are seated by means of the respective pins 7 and 22. The cam 28 of the pin 7 is directed in a direction other than that of the cam 28 of the pin 22. Both recesses 29 are arranged such that the aforementioned swivelling movements of the lock pawl 6 and of the pestle 21 are possible with adequate play. Thus, the pestle 21 and the lock pawl 6 are prevented from being mutually interchanged during assembly, because these component parts can never be mounted in an incorrect manner on account of the differing directions in which the cams 28 are oriented in connection with the profile shape of the lock pawl 6 and of the pestle 21.

Figure 4:
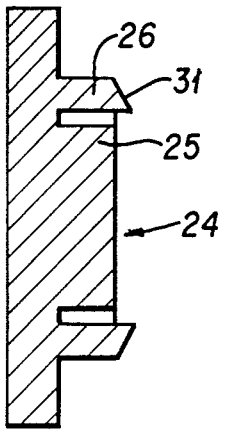
FIG. 4 is a section view along line IV—IV of FIG. 3.
Figure 5:
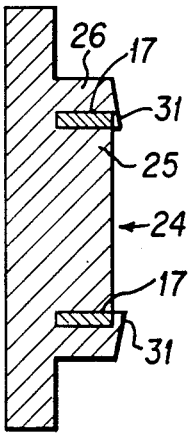
FIG. 5 shows a section view similar to that of FIG. 4 but with the mounted leaf spring being maintained in position by pinched protrusions.

For securing the leaf spring 17 against falling out of its mounting, there are provided on the outer wall 26 of the mounting 24 for the leaf spring 17, as shown in FIGS. 4 and 5, protrusions 31 which extend beyond the cross section of the leaf spring and can be pinched over this cross section, starting from the original shape shown in FIG. 4, to the pinched final shape, shown in FIG. 5. In the pinched final shape, the protrusions 31 extend over the leaf spring 17, so that this spring cannot fall out of the groove delimited by the walls 25 and 26. The protrusions 31 are conveniently arranged at those ends of the walls 25 and 26, which have the greatest distance from the bent portion 27.

In special cases, the digit rollers 1 may carry symbols in place of digits, for example letters.

The set of digit rollers 1 and of bearing plates 10 are secured against being drawn off by a circlip 32 put onto the axis 2.

Although the best mode contemplated by the inventor for carrying out the present invention as of the filing date hereof has been shown and described herein, it will be apparent to those skilled in the art that suitable modifications, variations, and equivalents may be made without departing from the scope of the invention, such scope being limited solely by the terms of the following claims.

I claim:

1. A roller counter, comprising:

an axle member;

at least two digit rollers rotatably supported by said axle member;

a teeth pair integral with each digit roller of said at least two digit rollers;

a plurality of stepping pinions, one of said plurality of stepping pinions respectively for each said at least two digit rollers, each of said plurality of stepping pinions being bearingly supported on said axle member, said plurality of stepping pinions engaging said teeth pair for driving one of s aid at least two digit rollers;

a plurality of bearing plates fixedly attached to said axle member, each of said bearing plates being located on said axle member between adjacent digit rollers of said at least two digit rollers, each of said plurality of hearing plates bearingly supporting respectively each of said plurality of stepping pinions;

at least one collar, said at least one collar being non-rotatably mounted between said at least two digit rollers and s aid axle member;

at least one ring bearingly supported by said at least one collar, said at least one ring having a toothed surface in gearing engagement with one of said plurality of stepping pinions of a respective digit roller, said at least one ring further having a center facing surface having a plurality of center facing recesses;

a lock pawl supported on each of said at least two digit roller, respectively, said lock pawl engaging one of said plurality of center facing recesses for orienting said at least one ring in a fixed direction relative to a respective digit roller; and zero setting means for zero setting said at least two digit rollers, said zero setting means comprising:

a leaf spring having a bent portion forming two legs on either side thereof, said two legs having an inside surface generally facing each other, said two legs having an outside surface generally facing away from each other, one leg of said leaf spring biasing said lock pawl towards said plurality of center facing recesses;

at least two stop notches in said axle member, one of each of said at least two stop notches being located relative to one of each of said at least two digit rollers;

pestle means swivellably supported on said at least one ring, said pestle means being biased toward said axle member by the other leg of said two legs of said leaf spring; and lateral protrusions on each of said at least two digit rollers for holding said leaf spring in a predetermined location, said lateral protrusions forming walls contacting said two legs, said lateral protrusions having an outer well contacting a portion of said outside surface of each said two legs of said leaf spring, said lateral protrusions further comprising a contiguous wall portion contacting said leaf spring along said bent portion, said lateral protrusions further comprising an inner wall contacting a portion of said inside surface of each said two legs of said leaf spring, said lateral protrusions further having protrusions extending beyond said leaf spring to permit pinching said protrusions over said leaf spring for holding said leaf spring to one of said at least two digit rollers.

2. The roller counter of claim 1, wherein said lateral protrusions contact said two legs on both said inside and said outside surfaces.

3. The roller counter of claim 2, wherein said lateral protrusions follow symmetrically each of said two legs of said leaf spring.

4. The roller counter of claim 1, wherein at substantially the apex of said bent portion of said leaf spring, said wall portion contacting said leaf spring along said bent portion is relieved from said inside surface so that said leaf spring is not contacted thereat by said wall portion.

5. The roller counter of claim 1, wherein said two legs of said leaf spring are of substantially equal length.

6. The roller counter of claim 1, wherein said bent portion of said leaf spring is formed by said leaf spring being bent into a V-shape.

7. The roller counter of claim 1, wherein said bent portion of said leaf spring is formed by said leaf spring being bent into a U-shape.

8. The roller of claim 1, wherein said at least two stop notches are each formed a depression in said axle member.

9. The roller counter of claim 1, wherein each said at least two digit rollers has at least two bearing bores, one each for mounting said lock pawl and said pestle means, each said bearing bore having a recess, and wherein said roller counter further comprises a pin inserted in each said bearing bore of each said digit roller; and a cam located on each said pin, each said cam extending radially outward from each said pin for engaging said recess of said bearing bore in which each said pin has been inserted, each said recess being dimensionally larger than each said cam by an amount that allows said pestle means to swivel between each said stop notch and said periphery of said axle member, and respectively allows said lock pawl to swivel from each said center facing recess to said center facing surface of said at least one ring, said cam on said pin for said pestle means being oriented in a direction other than that of said cam of said pin for said lock pawl.

10. The roller counter of claim 3, wherein at substantially the apex of said bent portion of said leaf spring, said wall portion contacting said leaf spring along said bent portion is relieved from said inside surface so that said leaf spring is not contacted thereat by said wall portion.

11. The roller counter of claim 2, wherein at substantially the apex of said bent portion of said leaf spring, said wall portion contacting said leaf spring along said bent portion is relieved from said inside surface so that said leaf spring is not contacted thereat by said wall portion.

12. The roller counter of claim 2, wherein said bent portion of said leaf spring is formed by said leaf spring being bent into a U-shape.

13. The roller counter of claim 3, wherein said bent portion of said leaf spring is formed by said leaf spring being bent into a U-shape.

14. The roller counter of claim 12, wherein said at least two stop notches are each formed by a depression in said axle member.

15. The roller counter of claim 13, wherein said at least two stop notches are each formed by a depression in said axle member.

16. The roller counter of claim 15, wherein each said at least two digit rollers has at least two bearing bores, one each for mounting said lock pawl and said pestle means, each said bearing bore having a recess, and wherein said roller counter further comprises a pin inserted in each said bearing bore of each said digit roller; and a cam located on each said pin, each said cam extending radially outward from each said pin for engaging said recess of said bearing bore in which each said pin has been inserted, each said recess being dimensionally larger than each said cam by an amount that allows said pestle means to swivel between each said stop notch and said periphery of said axle member, and respectively allows said lock pawl to swivel from each said center facing recess to said center facing surface of said at least one ring, said cam on said pin for said pestle means being oriented in a direction other than that of said cam of said pin for said lock pawl.

17. The roller counter of claim 14, wherein each said at least two digit rollers has at least two bearing bores, one each for mounting said luck pawl and said pestle means, each said bearing bore having a recess, and wherein said roller counter further comprises a pin inserted in each said bearing bore of each said digit roller; and a cam located on each said pin, each said cam extending radially outward from each said pin for engaging said recess of said bearing bore in which each said pin has been inserted, each said recess being dimensionally larger than each said cam by an amount that allows said pestle means to swivel between each said stop notch and said periphery of said axle member, and respectively allows said lock pawl to swivel from each said center facing recess to said center facing surface of said at least one ring, other than that of said cam of said pin for said lock pawl.

* * * * *

UNITED STATES PATENT AND TRADEMARK OFFICE

CERTIFICATE OF CORRECTION

PATENT NO. : 4,821,300

DATED : April 11, 1989

INVENTOR(S) : Herbert Pollmann

It is certified that error appears in the above-identified patent and that said Letters Patent is hereby corrected as shown below:

Column 5, line 35, delete "s aid" and insert ---- said ----.

Column 5, line 41, delete "hearing" and insert ---- bearing ----.

Column 5, line 46, delete "s aid" and insert ---- said ----.

Column 5, line 55, delete "roller" and insert ---- rollers ----.

Column 6, line 13, delete "well" and insert ---- wall ----.

Column 6, line 46, after "formed" insert ---- by ----.

Column 8, line 14, delete "luck" and insert ---- lock ----.

Column 8, line 29, before "other" insert ---- said cam on said pin for said pestle means being oriented in a direction ----.

Signed and Sealed this

Sixth Day of March, 1990

*Attest:*

JEFFREY M. SAMUELS

*Attesting Officer*

*Acting Commissioner of Patents and Trademarks*